United States Patent [19]

Palloch et al.

[11] Patent Number: 4,648,855

[45] Date of Patent: Mar. 10, 1987

[54] BELT GUARD

[75] Inventors: Herbert Palloch, Schwetzingen/Baden; Hans Erndt, Wiesloch, both of Fed. Rep. of Germany

[73] Assignee: Frankl & Kirchner GmbH & Co KG, Schwetzingen/Baden, Fed. Rep. of Germany

[21] Appl. No.: 830,647

[22] Filed: Feb. 18, 1986

[30] Foreign Application Priority Data

Feb. 19, 1985 [DE] Fed. Rep. of Germany ..... 3505627

[51] Int. Cl.[4] ..... B62J 13/00; F16P 1/02

[52] U.S. Cl. ..... 474/144

[58] Field of Search ..... 474/144; 74/606, 608; 30/382; 83/397, 478, 544, 546; 180/84

[56] References Cited

U.S. PATENT DOCUMENTS

| | | | |
|---|---|---|---|
| 1,453,673 | 5/1923 | Hebert | 474/144 X |
| 1,455,899 | 5/1923 | Cabelinsky | 474/144 X |
| 1,538,853 | 5/1925 | Hazelton | 474/144 |
| 1,722,078 | 7/1929 | Dreyer et al. | 474/144 X |
| 2,790,407 | 4/1957 | Andres | 474/144 X |
| 4,114,473 | 9/1978 | Pollak | 474/144 |

FOREIGN PATENT DOCUMENTS 2938253 4/1981 Fed. Rep. of Germany .

OTHER PUBLICATIONS

German Industrial Standards, DIN 42703, Feb. 1983, 2 pages.

*Primary Examiner*—Stephen J. Novosad
*Attorney, Agent, or Firm*—Felfe & Lynch

[57] ABSTRACT

A belt guard for clutch motors for industrial sewing machines comprises a cover made of two cover halves which can be clapped together. This cover extensively covers a V-belt pulley part of which accommodates a V-belt. In order to achieve an effective ingoing belt safety device which can be adapted to suit a variety of V-belt pulley diameters without exceeding the permissible maximum distances to the ingoing V-belt section on the one hand and to the V-belt pulley on the other the ingoing belt safety device comprises a safety pin extending into the wedge-shaped area between the ingoing V-belt section and the V-belt pulley. This pin can be attached to a safety slide bar fixed to a cover half in an adjustable manner, or to a disc serving as a mount for the cover halves.

11 Claims, 5 Drawing Figures

BELT GUARD

FIELD OF THE INVENTION

The invention relates to belt guards for attachment to a casing of a clutch of a clutch motor for industrial sewing machines with a cover which at least partially encloses a V-belt pulley and which has an opening for ingoing and outgoing V-belt sections, and with a belt anti-drop device located within the cover, its radial distance from the axis of the V-belt pulley being adjustable, whereby the cover is divided along a plane parallel to the axis of the V-belt pulley and whereby two cover halves are connected to each other at the side of the cover opposite to the opening by a joint and are connected to each other adjacent to the opening in such a way that they can be pulled apart.

BACKGROUND OF THE INVENTION

A belt guard of this kind is described in German laid-open Patent Application No. 29 38 253. This belt guard does not exhibit ingoing belt safety devices which are required according to German Industrial Standards (DIN 42 703).

SUMMARY OF THE INVENTION

It is a main object of the invention to develop belt guards of the type outlined in such a way that an effective ingoing belt safety device is attained which can be adjusted to suit various diameters of V-belt pulleys and which allows the cover halves to be pulled apart without this movement being hindered by the safety device.

In accordance with the invention, this object is accomplished in a belt guard wherein an ingoing belt safety device is provided which comprises a safety pin extending into the wedge-shaped area between the ingoing belt section and the V-belt pulley, and wherein the safety pin is attached to a safety slide bar which is attached in its turn to the outer side of a cover half in such a way that it can be detached if required, and wherein the safety pin penetrates at least one opening in the cover half and can be adjusted within this opening.

In a second solution this object of the invention is accomplished in a belt guard wherein the cover halves can be fixed to a circular disc which is attached to the casing, and wherein an ingoing belt safety device is provided which comprises a safety pin extending into a wedge-shaped area between the ingoing belt section and the V-belt pulley, and wherein the safety pin is attached to the disc in an opening and can be adjusted within this opening.

Both solutions presented by the invention feature a safety pin which extends into the wedge-shaped area between the ingoing belt section on the one hand and the V-belt pulley on the other and which extends through and beyond the V-belt pulley. This safety pin can be adjusted in such a way that the maximum distance required by DIN 42 703 from the ingoing belt section on the one hand and from the V-belt pulley on the other can be maintained through simply shifting the safety pin and, if necessary, turning of the cover, whenever V-belt pulleys of various diameters are used. Both solutions presented by the invention allow the cover halves to be pulled apart without the ingoing belt safety device hindering this movement.

Additional advantages and features of the invention are set forth in the claims and in the following description of embodiments of belt guards in accordance with the invention.

DETAILED DESCRIPTION OF THE INVENTION

Figure 1:
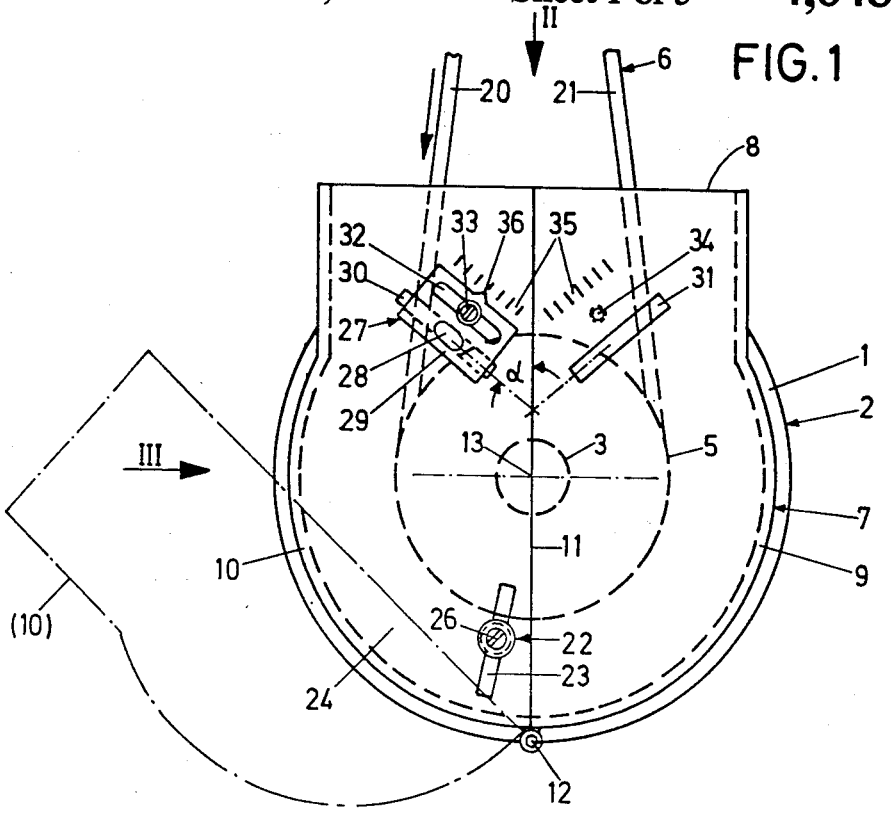
FIG. 1 is a frontal view of a belt guard corresponding to arrow I in FIGS. 2 and 3.
Figure 2:
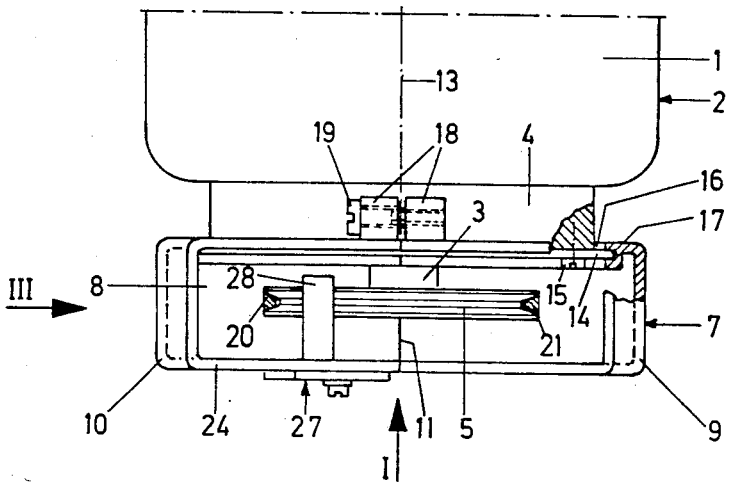
FIG. 2 is a top view of the guard corresponding to arrow II in FIGS. 1 and 3.
Figure 3:
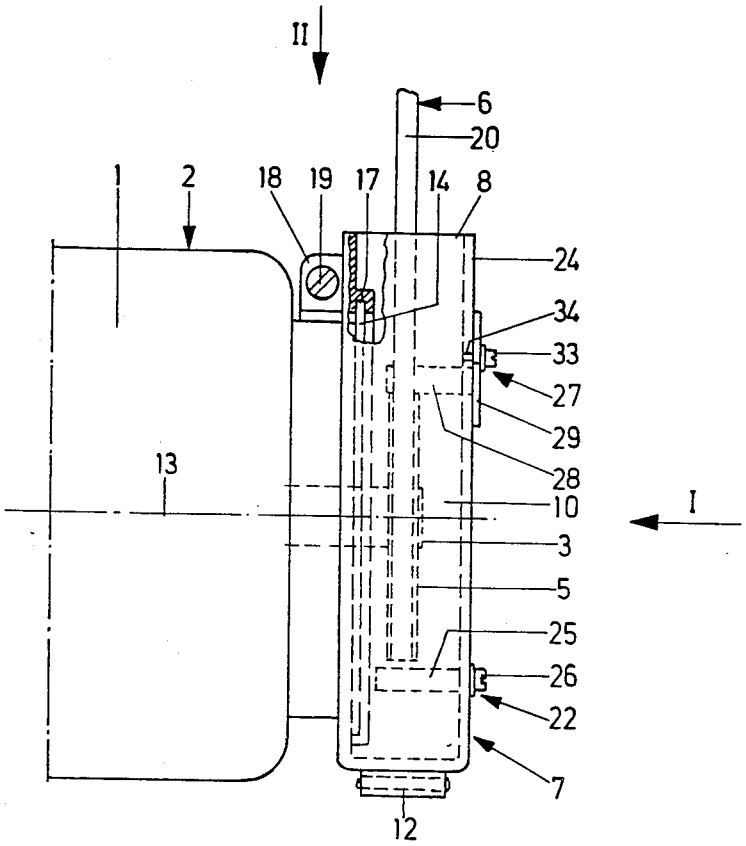
FIG. 3 is a side view corresponding to arrow III in FIGS. 1 and 2.

The belt guard shown in FIGS. 1 to 3 is designed to be fixed to a casing 1 of a clutch 2 of a clutch motor—not illustrated here—for use on industrial sewing machines. The casing 1 shows a ring flange 4 positioned concentrically to a shaft 3 coming from the casing 1. A V-belt pulley 5 is attached to the free end of the shaft 3 around which a V-belt 6 is guided with an angle of contact of approximately 250° to drive an industrial sewing machine.

The belt guard presented in FIGS. 1 to 3 comprises a cover 7 which encloses the V-belt pulley 5 with space between the two and an appropriate opening 8 for ingoing and outgoing V-belt sections 6 on the side where the V-belt enters and leaves the casing. The cover 7 has a mirror symmetric shape and is located congruent to the corresponding plane of symmetry of the V-belt 6. The cover 7 is divided along this plane of symmetry. The two cover halves 9, 10 closely meet along a dividing plane 11. They are connected by a joint 12 located on the opposite side to the opening 8, this joint allows the halves of cover 7 to be pulled apart as shown in the dot-dash representation in FIG. 1. The joint 12 is positioned parallel to the axis 13 of the shaft 3. The axis 13 is also situated in the dividing plane 11.

A circular disc 14 is fixed at the ring flange 4 of the casing 1 of the clutch 2 in a concentric and vertical position to the axis 13 by screws 15. A circular opening 16 has been made in the side of the cover 7 which faces the clutch 2. The diameter of this circular opening 16 is somewhat smaller than that of the disc 14. A ring groove 17 has been made in the margin area of this circular opening, the diameter and depth of which correspond to the diameter and thickness of the disc 14. When the cover halves 9, 10 are pulled apart they can be brought into a position in relation to the disc 14 so that the outer perimeter of the disc moves into the ring groove 17. If the cover 7 is closed by pushing the cover halves 9, 10 together, the outer perimeter of the disc 14 is encompassed by the ring groove 17, i.e. the cover 7 is fixed to the casing 1 of the clutch 2 and is immobile in the direction of the axis 13. The two cover halves 9, 10 have two plate elements 18 which are situated near the opening 8 on the side of the cover adjacent to the casing 1 on both sides of the dividing plane 11. The plate elements 18 are connected by a screw 19. By appropriate tightening of the screw 19 the cover halves 9, 10 can be braced against each other and thus against the disc 14 in such a way that they cannot be moved on this disc. By slightly loosening the screw 19 the cover 7 can be made to turn on the disc 14 so that an exact positioning of the cover 7 vis-à-vis the V-belt 6 is possible. The cover 7 will usually be positioned so that the ingoing belt section 20 of the V-belt 6 and the outgoing V-belt section run mirror-symmetrically to the dividing plane.

A belt anti-drop device 22 is attached to one cover half 10 on the side opposite to the opening 8 which is the side adjacent to the joint 12, i.e. opposite to the side where the belt enters and leaves. A slit 23 extending radially to the axis 13 has been made in the outer side 24 of the cover half 10 facing away from the casing 1. A catch 25 in the form of a pin or similar extending through and beyond the outer perimeter of the V-belt pulley 5 has been fixed here by an attachment screw 26. When the attachment screw 26 has been slightly loosened this catch 25 can be shifted in the longitudinal direction of the slit 23 so that for every conceivable V-belt pulley diameter or every conceivable position of the cover 7 on the casing 1 it can be positioned and fixed at the maximum distance required by DIN 42 703 of 3 mm to the outer perimeter of the V-belt pulley 5. As can be seen from FIG. 1 the belt anti-drop device 22 does not prevent the cover halves 9, 10 from being pulled apart.

An ingoing belt safety device 27 is provided in the cover half 10 accommodating the ingoing belt section 20 of the V-belt 6. This comprises a safety pin 28—a peg or similar—which extends into the wedge-shaped area between the ingoing belt section 20 of the V-belt 6 and the V-belt pulley 5, which is not encompassed by the V-belt 6 at this point, whereby the distance from the safety pin 28 to the perimeter of the V-belt pulley 5 on the one hand and to the ingoing belt section 20 on the other hand may not exceed a maximum of 4 mm according to DIN 42 703. This safety pin 28 running parallel to the axis 3 penetrates through the cover 7 to the same extent as the catch 25.

The safety pin 28 is secured to one of the safety slide bars 29 fixed to the outer side 24 of the cover half 10. The safety pin 28 passes through a slit 30 located in the outer side 24 into the inside of the cover 7. This slit 30 is positioned running at an angle $\alpha$ to the dividing plane 11 in such a way that the aforementioned stipulation on the distance from the safety pin 28 to the perimeter of the V-belt pulley 5 on the one hand and to the ingoing belt section 20 of the V-belt 6 on the other is observed given the differing diameters of the V-belt pulley. A further slit 31 can be located in the other cover half 9 mirror-symmetrically to this slit 30 so that the ingoing belt safety device 27 can be easily relocated if the direction of rotation changes. The angle $\alpha$ is approximately 35° to 50°.

The safety slide bar 29 itself has an elongated guide hole 32 through which a locking screw 33 is screwed in a threaded bore 34 in the outer side 24 of the corresponding cover half 10. In order to position the safety pin 28 as described, the locking screw 33 is slightly loosened so that the safety slide bar 29 can be shifted in the direction of its elongated guide hole 32 parallel to slid 30. Furthermore, the cover 7 can be turned slightly to achieve an exact positioning of the safety pin 28 relative to the ingoing V-belt section 20. If the cover 7 is to be removed from the casing 1 of the clutch 2, the locking screw 33 is completely loosened so that the safety slide bar parallel to the axis 13 can be removed, whereby the safety pin 28 comes out of its locking position between the ingoing V-belt section 20 and the disc 5. Finally, the two cover halves 9, 10 can be pulled apart.

A scale 35 has been placed on the outer side 24 parallel to slit 30 and 31 to which a marker 36 in the form of a pointer on the safety slide bar 29 has been assigned so that when the appropriate setting has been made on the scale 35 according to the diameter of the V-belt pulley 5 the correct position for the ingoing belt safety device 27 can be found without the necessity to first test and measure. The distance already described between the safety pin 28 and the ingoing V-belt section 20 is also set here by a final minimal turning of the cover 7.

Figure 4:
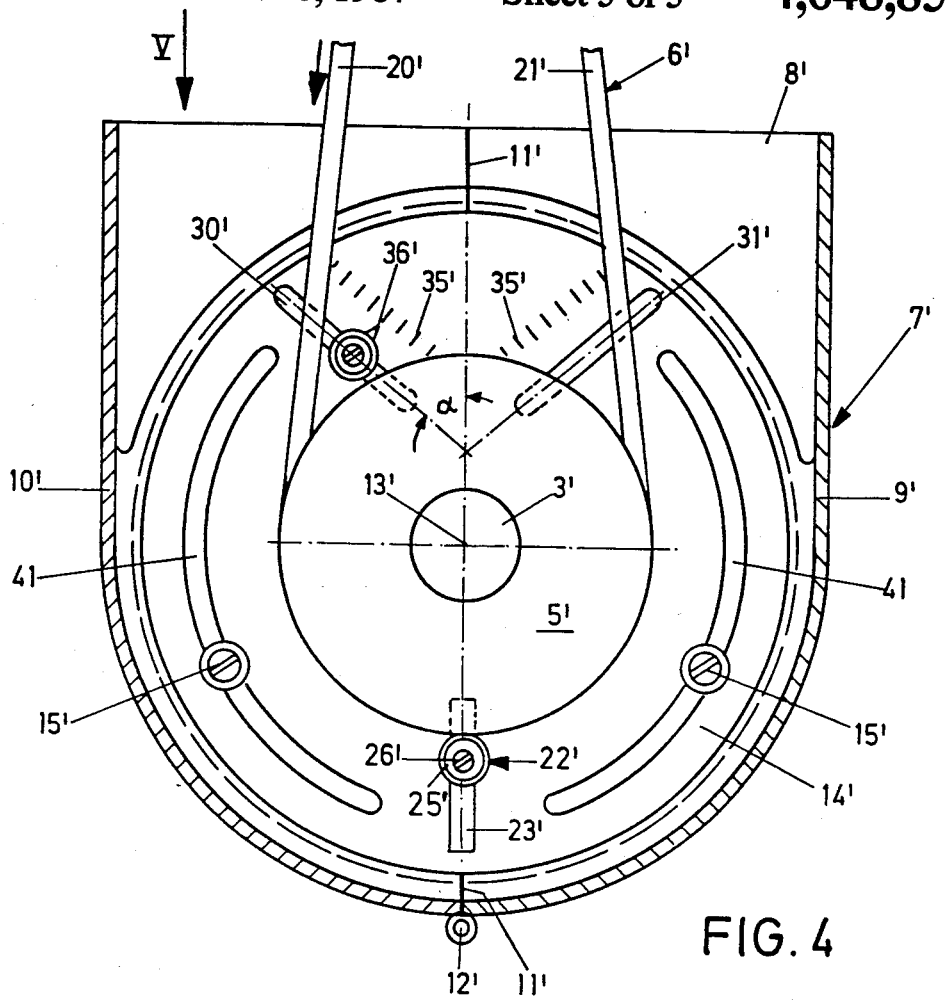
FIG. 4 is a vertical section of another embodiment of a belt guard corresponding to the intersection line IV—IV in FIG. 5.
Figure 5:
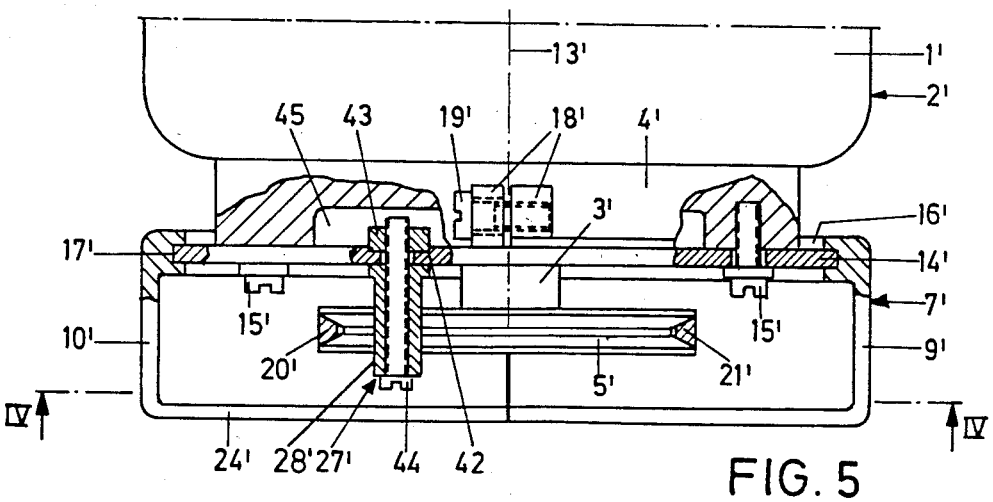
FIG. 5 is a top view of the belt guard according to the arrow V in FIG. 4.

Since the example according to FIGS. 4 and 5 differs from the example illustrated in FIGS. 1 to 3 in part only, the identical or at least similar and functionally identical parts are characterized by the same number together with an apostrophe ' so that the description must not be repeated.

The disc 14', which is also circular in this example, has arc-shaped elongated holes 41 positioned concentrically to the axis 13' to accommodate the screws 15' in order to allow the disc 14' to be turned and positioned around the axis 13'.

An ingoing belt safety device 27' is attached to the disc 14'. A slit 30' has been made in the disc 14' to accommodate this ingoing belt safety device 27'. For reasons which have already been shown another mirror-symmetrical slit 31' can be provided. There is a guide recess 42 in the side of the disc 14' facing the casing 1' for a threaded nut 43 which can be shifted in the guide recess 42 in the direction of the slit 30' (or 31' as the case may be) whilst remaining torsionally-rigid. A securing screw 44 is screwed into the threaded nut 43. This screw penetrates a sleeve-shaped safety pin 28' and is braced against the disc 14'. This safety pin 28' extends from the disc 14' into the wedge-shaped area between the ingoing V-belt section 20' and the V-belt pulley 5' at the maximum distances described above. It is possible to remove the cover 7' without loosening or removing the ingoing belt safety device. When the cover 7' is removed a simple positioning of the ingoing belt safety device is possible. This is effected by sliding the ingoing belt safety device in the slit 30' (or 31' as the case may be) whereby the disc 14' can be simultaneously turned as required. The position of the cover 7' is not effected by this.

A belt anti-drop device 22' is attached to the disc 14' on the side opposite to the ingoing and outgoing V-belt sections 20', 21'. The construction of this belt anti-drop device 22' is identical to that of the ingoing belt safety device 27'. The catch 25' is formed by a sleeve-shaped element which is screwed into a threaded nut 43 which is not shown separately in the diagram by a securing screw 26'. The corresponding slit 23' runs radially to the axis 13'.

There is an appropriate recess 45' in the ring flange 4' so that the disc 14' can be turned and positioned whilst both the belt anti-drop device 22' and the ingoing belt safety device 27' are in place.

In the two examples not only straight but also arched slits 30, 31 and 30', 31' respectively are possible in order to be able to satisfy as exactly as possible the above-described requirement for maximum distances from the safety pin 28, 28' to the V-belt pulley 5, 5' on the one hand and the ingoing V-belt section 20, 20' on the other.

In particular in the examples shown in FIGS. 4 and 5, the respective slit 23' or 30', 31' can be replaced by a series of adjacent holes so that the positioning of the belt anti-drop device 22' or the ingoing belt safety device 27' can be graduated. In this case, the respective hole can be designed as a threaded bore so that the guide recess 42 and the threaded nut 43 are rendered superfluous, i.e. the safety screw 44 or 26' can be screwed directly into the appropriate threaded bore. In the same way it is possible to replace slit 23 in the example shown in FIGS. 1 to 3 by a series of holes which accommodate the catch 25.

Similarly, the elongated guide hole 32 in the safety slide bar 29 as shown in the example in FIG. 1 to 3 can be replaced by a series of holes of this kind which then accommodate the locking screw 33.

What is claimed is:

1. A belt guard for attachment to a casing of a clutch of a clutch motor for an industrial sewing machine having a V-belt pulley and a V-belt comprising: a cover which at least partially encloses a V-belt pulley and which has an opening for ingoing and outgoing V-belt sectios, a belt antidrop device located within the cover, its radial distance from the axis of the V-belt pulley being adjustable, the cover being divided along a plane parallel to the axis of the V-belt pulley, a joint connecting two cover halves to each other at the side of the cover opposite to the opening, the cover halves being connected to each other adjacent to the opening in such a way that they can be pulled apart, an ingoing belt safety device which comprises a safety pin extending into a wedge-shaped region between the ingoing belt section and the V-belt pulley, and a safety slide bar which is attached in its turn to the outer side of a cover half in such a way that it can be detached if required, the safety pin being attached to the safety slide bar and the safety pin penetrating at least one opening in the cover half and being adjustable within this opening.

2. A belt guard according to claim 1, wherein the opening in the cover half is in the form of a slit.

3. A belt guard according to claim 1, wherein the opening in the cover half is formed by several adjacent holes.

4. A belt guard according to claim 1, which includes symmetrical openings in the cover halves.

5. A belt guard according to claim 1, in which the opening in the cover half is an elongated guide hole and which includes a locking screw and wherein the safety slide bar is attached to the cover by the elongated guide hole and the locking screw in such a way that it can be detached if required.

6. A belt guard according to claim 1, which includes a fixed scale and a marker which moves with the ingoing belt safety device, the fixed scale and the marker being related to the ingoing belt safety device.

7. A belt guard for attachment to a casing of a clutch of a clutch motor for industrial sewing machines comprising: a cover which at least partially encloses a V-belt pulley and which has an opening for ingoing and outgoing V-belt sections, a belt antidrop device located within the cover, its radial distance from the axis of the V-belt pulley being adjustable, the cover being divided along a plane parallel to the axis of the V-belt pulley, a joint connecting two cover halves to each other at the side of the cover opposite to the opening, the cover halves being connected to each other adjacent to the opening in such a way that they can be pulled apart, a circular disc which is attached to the casing, the cover halves being attachable to the circular disc, an ingoing belt safety device which comprises a safety pin extending into a wedge-shaped region between the ingoing belt section and the V-belt pulley, the safety pin being attached to the disc in an opening thereof and adjustable within this opening.

8. A belt guard according to claim 7, wherein the disc opening is in the form of a slit.

9. A belt guard according to claim 7, wherein the disc opening is formed by several adjacent holes.

10. A belt guard according to claim 7, which includes symmetrical disc openings.

11. A belt guard according to claim 7, which includes a fixed scale and a marker which moves with the ingoing belt safety device, the fixed scale and the marker being related to the ingoing belt safety device.

* * * * *